United States Patent [19]

Wolf

[11] 4,043,554

[45] Aug. 23, 1977

[54] WEIGHT GAME

[76] Inventor: Tobin Wolf, 285 Aycrigg Ave., Passaic, N.J. 07055

[21] Appl. No.: 735,997

[22] Filed: Oct. 27, 1976

[51] Int. Cl.[2] ..... A63F 9/00

[52] U.S. Cl. ..... 273/1 M; 273/1 R

[58] Field of Search ..... 273/1 R, 1 E, 1 M, 102.1 R, 273/102.1 C, 102.1 D, 102.1 G; 272/1 R, 6

[56] References Cited

U.S. PATENT DOCUMENTS

| | | | |
|---|---|---|---|
| 3,589,723 | 6/1971 | Glass et al. | 273/1 R |
| 3,795,400 | 3/1974 | Glass et al. | 273/1 R |
| 3,809,396 | 5/1974 | Leicht et al. | 273/1 R |

*Primary Examiner*—Paul E. Shapiro

*Attorney, Agent, or Firm*—Jay M. Cantor

[57] ABSTRACT

A children's game wherein weighted object of unknown weight are positioned at one end of a pulley string in accordance with a random or other selection caused by the use of dice or spinner devices wherein the other end of the pulley string is caused to move when the weight of the weighted objects overcomes the force holding the string and a weighted element in position at the other end of the pulley string. The weighted element moves upwardly in response to the downward force at the other end of the pulley string to overcome the force holding the weighted element in place, and moves upwardly to grasp a further weighted device and thereby return to its initial position. In accordance with the game instructions, the player placing the weighted object on the end of the pulley string which causes the weighted element to move upwardly is the loser.

18 Claims, 6 Drawing Figures

Fig. 5
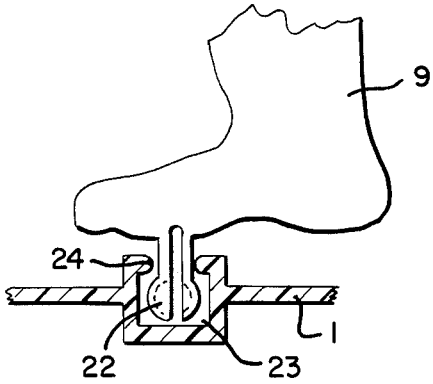
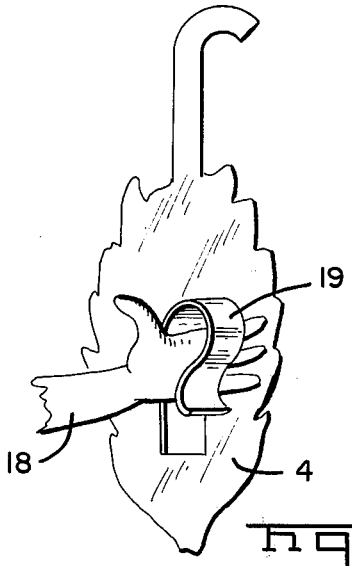
Fig. 4
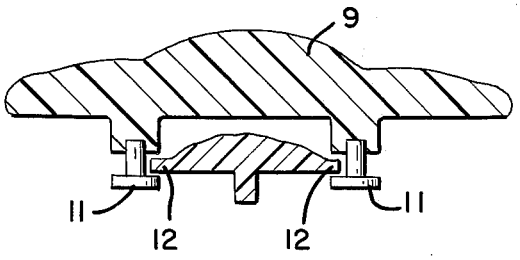
Fig. 7
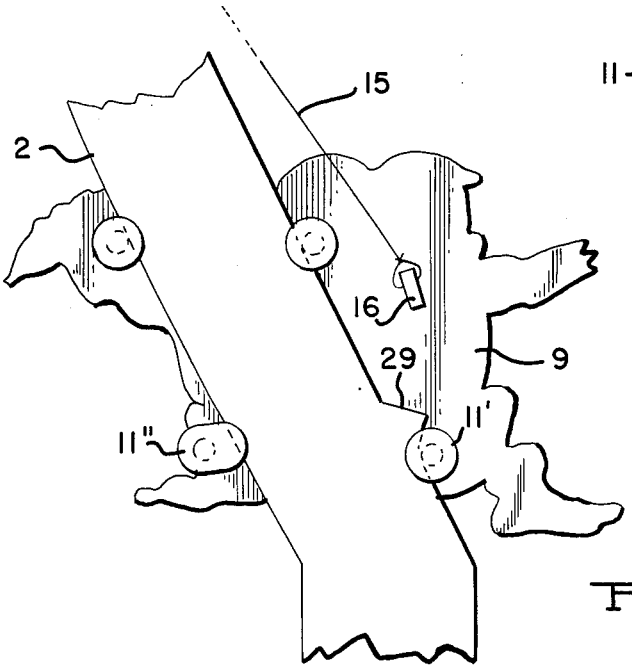
Fig. 6

WEIGHT GAME

This invention relates to a simple children's game which requires no reading ability and minimal manipulative skill.

Briefly, in accordance with the present invention, weighted objects of unknown weight are positioned at one end of a pulley string in accordance with a random or other selection caused by the use of dice or spinner devices wherein the other end of the pulley string is caused to move when the weight of the weighted objects overcomes the force holding the string and a weighted element in position at the other end of the pulley string. The weighted element moves upwardly in response to the downward force at the other end of the pulley string to overcome the force holding the weighted element in place, and moves upwardly to grasp a further weighted device and thereby return to its initial position. In accordance with the game instructions, the player placing the weighted object on the end of the pulley string which causes the weighted element to move upwardly is the loser.

It is therefore an object of this invention to provide a game wherein weighted objects of different predetermined weights are positioned at the end of a pulley string until the force holding a weighted element at the other end of the pulley string is overcome to cause a sudden upward movement of the element, such upward movement causing release of a weighted device and coupling thereof to the weighted element to cause the element to return to its initial position.

It is a further object of this invention to provide a simple and amusing game for very young children which does not require reading ability and requires a minimal amount of manipulative skill.

The above objects and still further objects will immediately become apparent to those skilled in the art after consideration of the following preferred embodiments thereof, which is provided by way of example and not by way of limitation wherein:

FIG. 3 is a section taken along the line 3—3 of FIG. 2;

FIG. 4 is a diagram of the coupling action between the weighted device 4 and the hand 18 of the weighted element 9;

FIG. 5 is an alternate form of locking the weighted element in position; and

FIG. 6 is a further alternate form of locking the weighted element in position.

Figure 1:
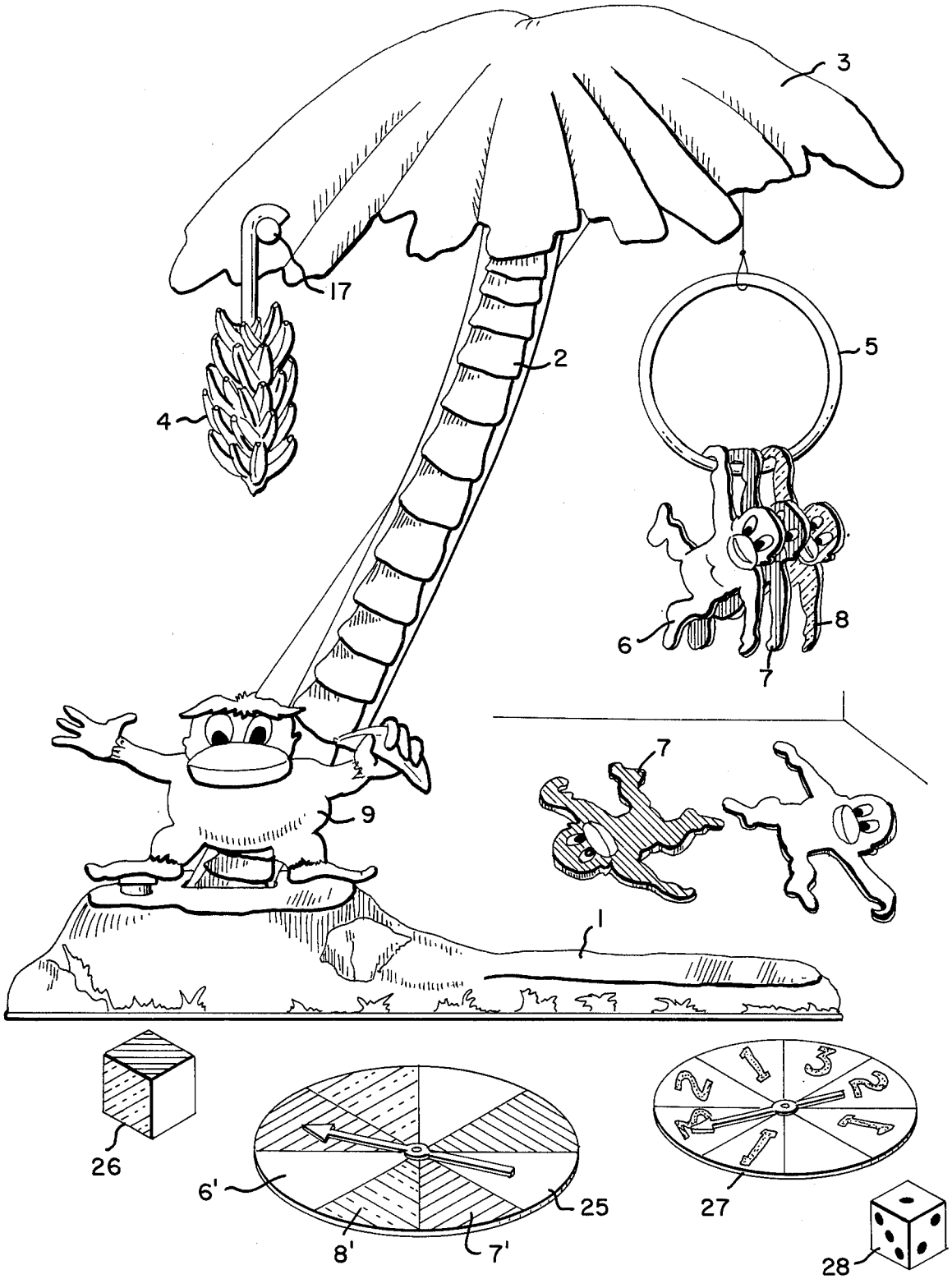
FIG. 1 is a front view of the game in accordance with the present invention.
Figure 2:
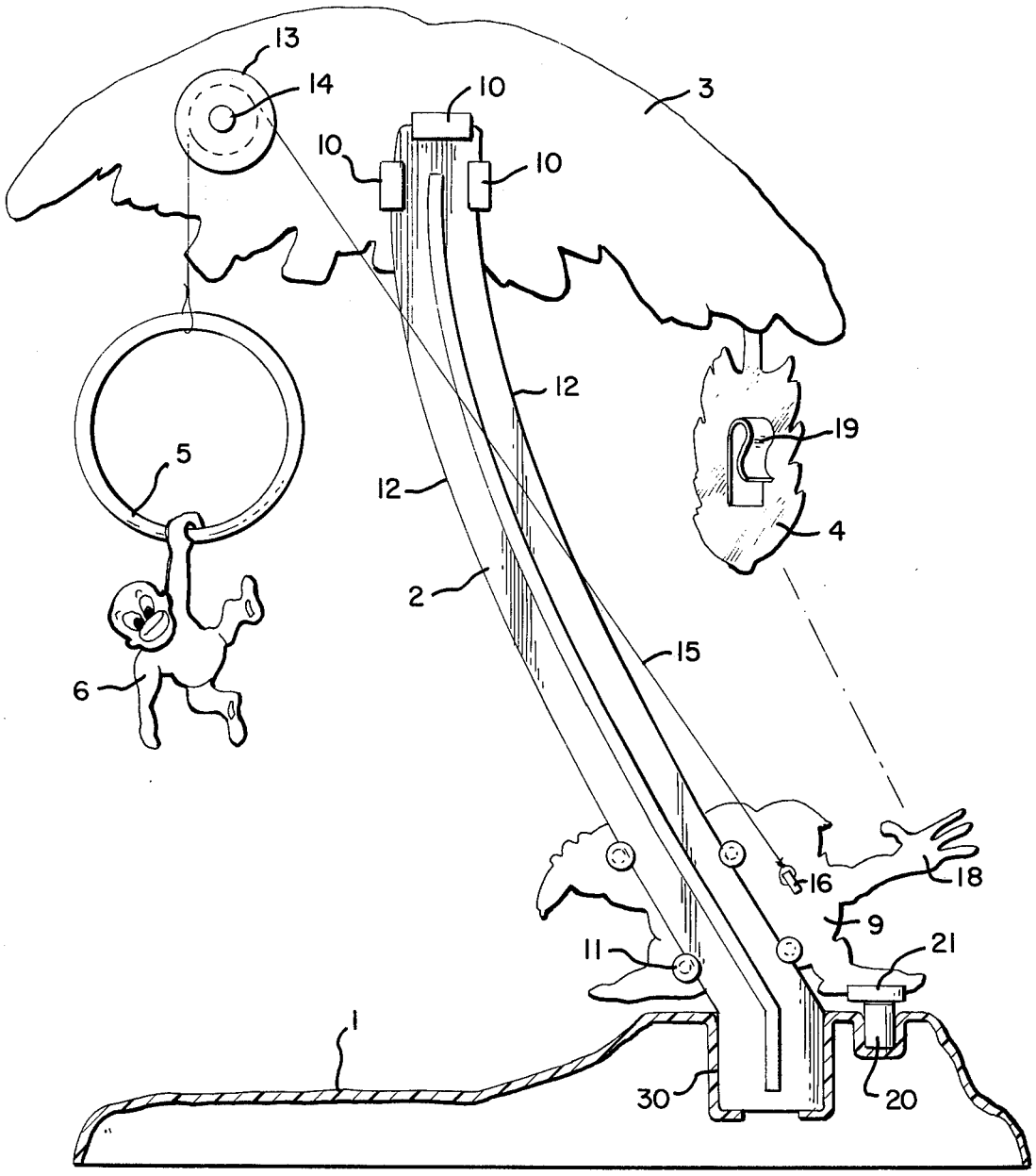
FIG. 2 is a rear view of the game in accordance with the present invention.

Referring now to FIGS. 1 and 2, there is shown the preferred embodiment of the present invention. The game includes a base 1 in the shape of an island with a tree positioned thereon having a trunk 2 and a top 3. A weighted device 4 in the form of a bunch of bananas hangs from the treetop 3 on the pin 17 secured to the treetop. Also seen hanging down from the tree is a ring 5 from which a number of weighted objects in the form of monkeys of different colors and weights 6, 7 and 8 may be suspended. The ring 5 is secured to the end of a pulley string as will be explained in more detail hereinbelow. A weighted element in the form of a monster 9 is secured to the other end of the pulley string.

As is better shown in FIG. 2, the pulley 13 is rotatably mounted on a shaft or pin 14 secured in the rear of treetop 3. The pulley string 15 which is of a very light weight compared to the weight of the monster 9, so that it has negligible affect on game operation, is tied to the ring 5, threaded over the pulley 13 and tied to a hook 16 mounted on the rear of the monster 9. It can be seen that the tree trunk 2 is mounted into a groove 30 in the base 1 and is also secured by means of tree tabs 10 to the treetop 3 at its other end to provide the illusion of a tree from the front as shown in FIG. 1.

It is apparent that if the accumulated weight of the monkeys on the ring 5 only slightly exceeds the weight of the monster 9 or if some excess force is applied to the ring 5, it may be sufficient to raise the monster but not sufficient to lift off the bunch of bananas 4. It is therefore necessary to hold back on the monster until a suffiicent weight can be accumulated on the ring 5 to cause an abrupt upward movement of the monster. This is accomplished by means of a magnet 20 positioned in the base 1 and an iron slug 21 affixed to the leg of the monster 9. Thus, when sufficient weight is hung on the ring 5 for the slug 21 to break away from the magnet, the magnetic force is removed and the downward force from the ring 5 with monkeys thereon will be sufficient so that the monster will ascend the tree with sufficient velocity to grasp the bunch of bananas 4, lift them off the pin 17, allow the descending monkeys on ring 5 to strike the base 1 so that they fall off the ring 5, thereby enabling the monster to descend the tree with the bunch of bananas in his hand.

As can been seen from FIGS. 2 and 3, the upward movement of the monster 9 is determined by the shape of the tree trunk 2 and the guides 11 mounted on the rear of the monster 9. The guides 11 are in slidable contact with the smooth edges 12 of the tree trunk and cause the monster to move upwardly along the path of the tree trunk.

Referring now to FIGS. 2 and 4, the upward movement of the monster 9 causes the hand 18 of the monster to engage the clip 19 affixed to the back of the bunch of bananas 4 as best shown in FIG. 4. This causes the bananas to be lifted from the pin 17 and adds additional weight to the monster 9. At this point in the path of travel of the monster 9, the monkeys 6, 7 and 8 will strike the ground or the base 1 and all or some of the monkeys will then fall off the ring 5, thus enabling the monster 9 to move downward under the force of gravity, carrying with him the bunch of bananas.

Referring now to FIG. 5, there is shown an alternative embodiment for the magnet 20 and slug 21 of FIG. 2. In FIG. 5 the slug 21 is replaced by a split pin 22 integral with the leg of the monster 9. The split pin is engaged in a cup 23 in the base 1, the cup having a restriction 24. The monster will stay in position until the weight of the monkeys is sufficient to cause the split pin 22 to move together due to the force of the bulbous portion thereof by the restricted portions 24 of the cup 23, whereby the split pin will move outwardly from the cup and allow the monster to move upwardly along the tree to reach the bananas.

Referring now to FIG. 6 there is shown a further alternative embodiment for the magnet 20 and the slug 21 of FIG. 2. In FIG. 6 an angular protrusion 29 on one edge 12 of the tree trunk 2 presents an obstruction to the movement of the guide 11'. The monster will therefore stay in position until the weight of the monkeys is sufficient to cause the guide 11' to cam over the angular protrusion 29 and allow the monster to move upwardly along the tree. The guide 11'' has sufficient clearance to permit lateral movement of the monster as it lifts over the protrusion 29.

The game is played by means of a die 26 or spinner element 25 wherein a player will roll a die or operate a spinner to determine which color monkey is to be placed onto the ring 5. This continues in turn until, eventually, there will be sufficient monkeys on the ring to cause the monster 9 to move upwardly and grab the bananas. It can be seen that the upward movement of the monster 9 is not dependent upon the number of monkeys on the ring 5 since each different color monkey will have a different weight. An alternative method of playing would be that the players merely choose the monkey without requiring the chance element of the spinner or die element. A still further embodiment would have all of the monkeys the same weight and employ a spinner 27 or die 28 having numbers instead of colors the number indicating the number of monkeys a player must hang on the ring.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A game comprising:

a. a pulley, b. a string passing over said pulley, c. weighted means at one end of said string, d. weight receiving means at the other end of said string, e. means responsive to a predetermined weight on said weight receiving means for moving said weighted means along a predetermined path, and f. means responsive to predetermined travel of said weighted means along said predetermined path for adding additional weight to said weighted means, whereby said weighted means retraces its travel path to substantially its original position.

2. A game as set forth in claim 1 wherein the weight of said string is substantially negligible relative to the weight of said weighted means.

3. A game as set forth in claim 1 wherein (e) includes means coupled to said weighted means for applying a force to said weighted means in a direction opposite to said predetermined path of travel.

4. A game as set forth in claim 2 wherein (e) includes means coupled to said weighted means for applying a force to said weighted means in a direction opposite to said predetermmined path of travel.

5. A game as set forth in claim 3 wherein said means coupled includes a magnet and magnetizable slug, one of said magnet and slug being secured to said weighted means and the other being secured to a stationary means.

6. A game as set forth in claim 4 wherein said means coupled includes a magnet and magnetizable slug, one of said magnet and slug being secured to said weighted means and the other being secured to a stationary means.

7. A game as set forth in claim 1 further including a mass positioned along said predetermined path, said weighted means including means to couple said weighted means to said mass to add said additional weight to said weighted means.

8. A game as set forth in claim 2 further including a mass positioned along said predetermined path, said weighted means including means to couple said weighted means to said mass to add said additional weight to said weighted means.

9. A game as set forth in claim 3 further including a mass positioned along said predetermined path, said weighted means including means to couple said weighted means to said mass to add said additional weight to said weighted means.

10. A game as set forth in claim 4 further including a mass positioned along said predetermined path, said weighted means including means to couple said weighted means to said mass to add said additional weight to said weighted means.

11. A game as set forth in claim 5 further including a mass positioned along said predetermined path, said weighted means including means to couple said weighted means to said mass to add said additional weight to said weighted means.

12. A game as set forth in claim 6 further including a mass positioned along said predetermined path, said weighted means including means to couple said weighted means to said mass to add said additional weight to said weighted means.

13. A game as set forth in claim 12 wherein said means responsive in (e) includes guide means on said weighted means and travel path means, said guide means moving along said travel path means.

14. A game as set forth in claim 10 further including a split pin mounted on said weighted means and a stationary cup for receiving said split pin, said cup having a restriction at its opening to provide an opening of smaller cross-section than said split pin in its normal state.

15. A game as set forth in claim 3 wherein said means coupled includes a protrusion and camming means responsive to said predetermined weight on said weight receiving means for riding over said protrusion.

16. A game as set forth in claim 4 wherein said means coupled includes a protrusion and camming means responsive to said predetermined weight on said weight receiving means for riding over said protrusion.

17. A game as set forth in claim 15 further including a mass positioned along said predetermined path, said weighted means including means to couple said weighted means to said mass to add said additional weight to said weighted means.

18. A game as set forth in claim 16 further including a mass positioned along said predetermined path, said weighted means including means to couple said weighted means to said mass to add said additional weight to said weighted means.

* * * * *